US011292664B2

(12) United States Patent
Tavsanli et al.

(10) Patent No.: US 11,292,664 B2
(45) Date of Patent: Apr. 5, 2022

(54) FLEXIBLE LARGE CONTAINER WITH A SEAM-FREE USEFUL SPACE

(71) Applicants: Bülent Tavsanli, Istanbul (TR); Alev Ulviye Ergen, Istanbul (TR); Cenk Kadir Bostan, Istanbul (TR); Atilla Teoman Bostan, Istanbul (TR)

(72) Inventors: Bülent Tavsanli, Istanbul (TR); Alev Ulviye Ergen, Istanbul (TR); Cenk Kadir Bostan, Istanbul (TR); Atilla Teoman Bostan, Istanbul (TR)

(73) Assignee: Alsan Plastik Tekstil Ve Metal San.Ve Tic.Ltd.Şti (TR)

( * ) Notice: Subject to any disclaimer, the term of this patent is extended or adjusted under 35 U.S.C. 154(b) by 0 days.

(21) Appl. No.: 15/039,050

(22) PCT Filed: Sep. 5, 2014

(86) PCT No.: PCT/EP2014/069016
§ 371 (c)(1),
(2) Date: May 25, 2016

(87) PCT Pub. No.: WO2015/074779
PCT Pub. Date: May 28, 2015

(65) Prior Publication Data

US 2016/0355331 A1 Dec. 8, 2016

(30) Foreign Application Priority Data

Nov. 25, 2013 (DE) ..... 102013113020.8

(51) Int. Cl.
*B65D 88/16* (2006.01)
*B65D 90/02* (2019.01)
*B65D 88/54* (2006.01)

(52) U.S. Cl.
CPC ..... *B65D 90/022* (2013.01); *B65D 88/1606* (2013.01); *B65D 88/1618* (2013.01);
(Continued)

(58) Field of Classification Search
CPC ..... B65D 88/16; B65D 88/1606; B65D 88/1612; B65D 88/1618; B65D 88/1625;
(Continued)

(56) References Cited

U.S. PATENT DOCUMENTS 1,701,097 A * 2/1929 Broderick ..... B65D 33/12 383/18
4,362,199 A * 12/1982 Futerman ..... B65D 88/1612 383/17
4,480,766 A * 11/1984 Platt ..... B65D 88/1681 222/105
4,646,357 A 2/1987 Nattrass
(Continued)

FOREIGN PATENT DOCUMENTS

DE 202007005406 U1 5/2008
GB 2097755 A 11/1982
(Continued)

OTHER PUBLICATIONS

JP1095493ATranslation (Year: 1998).*

*Primary Examiner* — Jes F Pascua
*Assistant Examiner* — Nina K Attel

(57) ABSTRACT

A flexible large container for transporting and storing a filling product. The container has a usable space formed by top, bottom, and side walls that are constructed from a plurality of fabric sheets. The portions of the fabric sheets that enclose the usable space are welded together to provide a stitchless usable space. Upper portions of the sidewalls extend upward beyond the usable space to form a hem. Lift loops that enable the large container to be lifted by mechanical means are sewn onto the hem. Thus, the usable space remains stitchless, i.e., without stitch holes, yet the lift loops are stitched to the hem.

12 Claims, 4 Drawing Sheets

(52) U.S. Cl.
CPC ..... *B65D 88/1631* (2013.01); *B65D 88/1668* (2013.01); *B65D 88/1681* (2013.01); *B65D 88/54* (2013.01)

(58) Field of Classification Search
CPC ..... B65D 88/1631; B65D 88/1637; B65D 88/1643; B65D 88/165; B65D 88/1656; B65D 88/1662; B65D 88/1668; B65D 88/1675; B65D 88/1681; B65D 88/1687; B65D 88/1693; B65D 88/18; B65D 88/20; B65D 88/22; B65D 88/24; B65D 33/06; B65D 33/10; B65D 33/105; B65D 33/12
USPC ..... 383/17, 20, 6
See application file for complete search history.

(56) References Cited

U.S. PATENT DOCUMENTS

| | | | | | |
|---|---|---|---|---|---|
| 5,468,528 | A * | 11/1995 | Schnaars | B65D 88/1631 | 383/107 |
| 6,302,584 | B1 * | 10/2001 | Derby | B29C 66/61 | 383/107 |
| 7,922,421 | B2 * | 4/2011 | McGillick, Sr. | B65D 88/1612 | 206/504 |
| 2013/0168391 | A1 * | 7/2013 | Hunter | B65D 25/04 | 220/7 |

FOREIGN PATENT DOCUMENTS

| | | | | |
|---|---|---|---|---|
| GB | 2130172 | A * | 5/1984 | B65D 88/1681 |
| GB | 2262504 | A | 6/1993 | |
| JP | 10095493 | A * | 4/1998 | |

* cited by examiner

Application No. 15/039,050
New Sheet 4 / 4

FLEXIBLE LARGE CONTAINER WITH A SEAM-FREE USEFUL SPACE

BACKGROUND INFORMATION

Field of the Invention

The invention relates to the field of containers for bulk material. More particularly, the invention relates to flexible large containers, also known as "big bags" or FIBC (flexible intermediate bulk containers).

Discussion of the Prior Art

Flexible large containers are typically constructed from section or sheets of woven fabric, for example, a woven fabric that uses flat, synthetic tapes/filaments as the weaving fiber. The large container forms a usable space for receiving bulk material, for transport and/or storage. In practice, polypropylene is frequently used as the weaving material, for economic reasons. Polypropylene has excellent mechanical properties and is inexpensive; it doesn't, however, weld well together. For that reason, the individual sections or fabric sheets that form the container and surround the usable space are stitched together.

When a fine-grained bulk material, for example, a powdered material, is to be filled into the container, it is particularly important that the container be leak-proof. And particularly, when the bulk material comes from the food processing industry, i.e., foodstuffs, such as flour or other milled grains, it is important to avoid leaks, because of the risk of attracting vermin. When the bulk material is pharmaceutical or chemical substances, then it is important, that the substances be unable to escape the container in an uncontrolled manner. The stitch holes on stitched seams are the primary source of leaks, and for this reason, it is known to use a special material for stitching seams that fills out the stitch holes as best as possible.

Basically, leaky seams is a problem that applies to all stitched seams, and this also includes the seams that stitch the fabric sheets together to create the usable space of the large container. Some seams are, however, subject to particularly heavy loading, such as, for example, the seams at the lift loops that are attached to the woven fabric of the large container and that are used to lift the container with a mechanical hoist, for example, a crane, a forklift, etc. The lift loops are generally made of a belt material, i.e., rugged webbing, and are sewn onto the flat sections of woven fabric. The heavy loading can exert a pull on the stitch holes in this area, increasing the risk of leaks.

The process of sewing individual fabric sheets together to form a flexible large container cannot be satisfactorily automated with current technologies. The seams are stitched manually, and the risk of faulty seams due to stitching errors is greater than in an automated process. Stitching errors can include, for example, portions of seams that are missing, which increases the loading on the remaining, existing seams, and empty stitch holes.

Large containers frequently have diagonally extending reinforcements in corner areas of the container that are attached to the container walls and extend into the usable space. The purpose of these reinforcements is to make the large container dimensionally stable or semi-rigid, in other words, although having flexible walls, the large container maintains its generally rectangular or cubic shape when empty and free-standing. The points of attachment of these reinforcements are also subjected to heavy loading.

Extra heavy loading occurs not only when the flexible large container is being lifted with a hoist, but also, for example, during vibration-enhanced filling or emptying operations, when several full containers are stacked on top of each other, or when the filled container is not standing on a completely flat substrate, but, for example, is supported only on the fork of a fork lift.

To prevent leakage, it is known to incorporate a so-called inliner into the flexible large container, i.e., a separate inner container that is placed into the usable space. This improves the properties of the container with regard to cleanliness, particularly with regard to quality requirements for pharmaceutical substances, as well as leak-proofing. The inliner can be made of a plastic film, for example, and not only prevent leaks, but also prevent the ingress of gas or moisture into the usable space. Multi-layer films can be also used to ensure the desired barrier effect.

The use of such inliners is, however, problematic, in that the inliner can move freely, i.e., in an uncontrolled way, inside the outer bag of the large container. Consequently, if the film is twisted when inserted, it can form folds or lump together, and this can hinder the process of filling or emptying the large container. Fixedly attaching the inliner with the outer material of the container has several drawbacks, one being that it impairs the ability to recycle the materials because the adhesive that is used to attach the inliner to the outer bag may not be compatible for recycling together with the materials of the outer bag of the large container and/or the inliner.

US 2003/0235350 A1 discloses a conventional large container that is used particularly for meat and meat products and that has a separate inner container, i.e., a liner, placed inside the actual container. The walls and the floor of the large container include several sheets of material that are stitched together. The large container is open at the top and does not have an upper cover. The upper edges of the walls are reinforced by means of an additional band that is stitched to these upper edges. Lift loops extend in two directions out beyond this reinforced upper edge: in the one direction they form the loop above the edge that is used for lifting and moving the large container and in the other direction they are stitched against the walls.

What is needed, therefore, is a flexible large container that has a leak-proof usable space for receiving bulk materials. What is further needed is such a container that can withstand the heavy loading that occurs when lifting, transporting, or stacking the container, without increasing the risk of a leak in the usable space. What is yet further needed is such a container that is easily filled and emptied.

BRIEF SUMMARY OF THE INVENTION

The invention is a flexible large container having sidewalls, a floor, and a cover that are constructed of woven fabric sheets and that surround a usable space that is stitchless. With a stitched seam, the tensile forces exerted on the large container are also applied to the seam and these forces act to pull the seam apart. Because of that, it may be advantageous, at least at places on the large container subject to particularly heavy loading, for example, at the floor and side seams, to join the fabric sheets with a method that is not sewing, i.e., does not entail stitching, but instead, to weld the edges of the fabric sheets together. The welded seams have to be done in a way that makes them capable of withstanding the heavy loading.

Using welded seams has the advantage that such seams are easily made leak-proof. The process of welding the sheets of fabric together can also be automated, thereby reducing the production costs. Materials that lend themselves to welding together are generally somewhat more expensive than the standard material used to manufacture flexible large containers, but the lower production costs offset the higher material acquisition costs.

The conventional woven fabric used to make large containers is made of polypropylene (PP). Individual sheets of the woven fabric are stitched together to form the large container and, as mentioned above, stitching creates stitch holes and these increase the risk of the bulk material leaking out of the large container. The usable space of the large container according to the invention is formed in a stitchless manner. Advantageously, the fabric sheets for the large container are made with or contain at least some polyethylene (PE). PE is more expensive than PP, but PE is weldable, which makes it possible to weld the seams of the fabric sheets together, rather than sewing them, thereby creating a stitchless usable space. The weldability of PE also makes it possible to automate the process of joining sheets together. In fact, PE is a very desirable material for making the woven fabric of the large container for a number of other reasons, such as its good resistance to UV radiation, heat, cold, and salt water, and the fact that it is readily recyclable.

The fabric sheets may be made exclusively of PE or a blend of PE and PP, but typically additives, such as pigments, anti-static substances, or similar substances, are added to the PE, and so, the sheets are not made solely of PE. The advantageous properties of PE, however, are particularly evident, when the fabric sheets are made primarily of PE.

Many types of PE are known and are commercially available with different cross-linking densities, referred to in the industry LDPE, LLDPE, MDPE, or HDPE and reference made hereinafter to just "PE" shall include all of these types. These types of PE or also material mixtures made from these types are suitable for use within the context of the present application. It is particularly advantageous to use a commercially available high-density polyethylene, abbreviated HDPE, because of its high strength.

Assuming, for example, that the fabric sheets are manufactured in a known fashion as a fabric woven with warp, i.e., vertical, weave fibers and weft, i.e., horizontal, weave fibers, then it is possible to use synthetic tape that contains PE for the first weave fibers that extend in one direction and to use a tape that is made of a different material for the second weave fibers that extend in a second direction. Ideally, however, all weave fibers, for example, the tapes used for the first weave fibers as well as for the second weave fibers, contain at least some portion of PE. This allows the fabric sheets woven with these tapes to be welded across a greater surface area along the weld line. The large container according to the invention, thus, has a usable space that is free of stitch holes, i.e., is stitchless, which results in a particularly leak-proof container.

The strength of the welded seams may be increased by placing an intermediate layer of weldable material, such as a strip of PE, between the two parts that are to be welded together. For example, a strip of PE film is placed between the overlapping edges of the two fabric sheets to be joined and the three layers welded together. Alternatively, the PE film may be laminated to one or to both of the parts to be welded together. Welded seams, particularly those that include an intermediate layer of PE (including LDPE and LLDPE) between the two layers to be welded, provide very strong seams that pass the necessary tests for seam strength for such large containers. Tests have shown that this added PE layer significantly increases the loading that the seam is able to withstand. Indeed, the seams were able to withstand loading five and even six times the nominal loading capacity of a large container. For example, a large container designed to carry 1,000 kg was able to be loaded with 5,000 kg or 6,000 kg.

Flexible large containers have lift loops, so that the bags may be hoisted and moved by mechanical means, such as a crane, fork lift, etc. The lift loops on the large container according to the invention are provided outside the usable space. Heavy loading is exerted on these lift loops when the bag is lifted by a fork lift, for example, and it is desirable to distribute this loading over a larger area, to reduce forces and stresses on the large container. Because of this, it is desirable to use stitching to secure the lift loops to the large container, a stitched attachment being more robust than a welded attachment. To this end, a hem is formed on the large container and the lift loops stitched to this hem. The sidewalls of the container extend upward beyond the usable space, forming the hem outside and above the usable space. The problematic regarding leaky seams doesn't apply to the hem area, so it doesn't matter if these stitch holes are pulled by the tensile forces acting on the loops.

Conventional large containers have a cover that is stitched to the sidewalls at the upper limit of the usable space. The stitching creates a narrow seam bead that measures one millimeter to just a few centimeters, and is not large enough to allow the lift loops to be attached to the bead.

The large container according to the invention has a cover that is joined to the sidewalls by means of welded seams. The fabric of the sidewalls extends upward beyond the cover to provide sufficient fabric to form a hem that has a height of several centimeters, for example, 8 to 15 cm, sufficiently large to allow the lift loops to be firmly stitched onto this hem only and not to a sidewall of the container. This embodiment of the hem is more advantageous, for mechanical reasons, than if the hem, for example, were to be formed by a particularly large cover that extended out over the sidewalls.

The hem may extend continuously along the upper circumferential edge above the usable space, i.e., along all four walls of a rectangular usable space. This has the advantage of distributing the forces exerted on the lift loops along the entire upper circumference, from where they are then transmitted into the walls of the large container. Alternatively, the hem may be provided in certain specific sections on the upper edge of the usable space where lift loops are needed. For example, hem sections may be provided near the corners of the four walls, so that four loops may be attached to the hem sections. With this construction, a cube-shaped large container may be lifted at its four upper corners and be handled in a conventional manner.

The lift loops may also be constructed as so-called tunnel loops, whereby a tube is formed by folding the fabric of the hem on each of two oppositely facing sides of the large container and stitching the lower edge of the folded fabric to the hem. Ideally, the tube extends along the entire length of the two hems, forming two tunnels that extend parallel to each other and to the cover. The tubes are open at least on one end, and typically on both ends, so that a hoisting tool can be inserted into them.

The lift loops according to the invention may be attached directly or indirectly to the hem. In a direct attachment, the lift loop is joined directly to the hem. In an indirect attachment, the lift loop may be first fastened to a belt and this belt then attached to the hem, either by stitching or welding. The lift loops and belt may also be fastened to the hem at the same time, so that the lift loops and the hem are affixed to each other there where the belt is fastened to the hem.

Classic sewing techniques may be used to attach the lift loops to the hem, or, depending on the material, the lift loops may be welded to the hem. Sewing typically provides a seam that can better withstand the high tensile forces that frequently occur when handling the large container. Sewing is described herein as a means of attaching the lift loops to the hem, but nevertheless, it is understood, that, depending on the intended use of the large container according to the invention, other methods of attaching the lift loops to the hem may be sufficient and suitable.

In a first embodiment, the lift loops may be formed by a belt that runs along the hem. The belt is essentially stitched to the hem along its entire length, and the loops are formed as an unstitched portion of the belt that does not make contact with the hem, but rather, extends upward in an omega (Ω) shape, creating lift loops that extend up away from the hem, to which a hoist may be attached, which, for example, has hooks that are provided to engage the lift loops.

In a second embodiment, the lift loops may be constructed as separate elements that are attached to the hem. The lift loops are U-shaped, and the two ends are attached to the hem. In this embodiment, too, the belt can run along the hem, to serve as a reinforcing element that distributes the forces exerted on the lift loops along the hem. The lift loops may, for example, be made of the same material as the belt itself.

In this second embodiment, with the separately formed lift loops, a particularly reliable and durable attachment of the lift loops is achieved by folding the ends of a loop over respective sections of the belt. The stitching to attach the lift loop to the belt is then stitched through three layers of material, namely, through the belt and the two sections of the lift loop on each side of the belt. This stitching may also be stitched through the hem, thereby stitching lift loop, belt, and hem together.

In a third embodiment, the lift loops are constructed as tunnel loops as previously mentioned, by folding the fabric of the sidewall that extends above the cover over on itself to form a tunnel. This is done on two opposite facing sidewalls, so as to form tubes that extend parallel to the cover. The tubes are open at least on one end, and typically on both ends, so that a hoisting tool can be inserted into them.

Alternatively or in addition to reinforcing the hem by stitching the belt to the hem, the container fabric itself may be reinforced at the place where the lift loops attach to the hem. Typically, the large container is made of a woven fabric, whereby the sidewalls extend upward above the cover and form the hem there. This woven fabric may be denser there where the lift loops attach to the hem, for example, the fiber density may be double or triple the usual fiber density. For example, the woven fabric may have 20 to 25 fibers per centimeter, instead of the approximately 10 fibers per centimeter. It is possible to configure the weaving process to obtain the desired density of warp fibers. The warp fibers, i.e., vertically running fibers, for example, may be closer together in specific areas. This configuration of warp fibers provides a weave with the desired strength that allows a distribution of the lift load over the entire height of the container.

Depending on the bulk material to be filled into the large container, it may be desirable to provide a particularly leak-proof embodiment of the large container, for example, in order to prevent the penetration of gas or moisture. A laminated material may be used to add leak-proof protection to the fabric sheets. An extra layer, for example, a plastic film, may be laminated onto the woven fabric sheet, whereby this plastic film then faces the inside of the usable space of the finished large container. This film can either have micro-perforations or be completely closed. The film makes the corresponding fabric sheet completely leak-proof, even against very small granulated sizes, such as a powder, of the bulk material. This film, provided as a so-called liner that is laminated to the woven fabric, either contains PE or consists entirely of PE and, thus, ensures easy weldability with the adjacent fabric sheets. The usable space of the large container made with these laminated woven fabric sheets that are joined by welding provides a completely leak-proof containment for powdered material or other fine-grain or moisture-sensitive materials.

It is frequently desirable that the large container be semi-rigid or dimensionally stable, i.e., that it not collapse or fold down on itself when being filled or emptied. Typically this is achieved in the industry by placing reinforcing supports at the corner areas of the usable space. For example, two adjacent walls that form a corner area are coupled to each other by means of a diagonally arranged reinforcing support. This support is flexible and may be made of a net, a section of film, a fabric, etc. The support has through-openings that are dimensioned to allow the bulk material to flow through them. This ensures that the usable space can be filled or emptied completely, including the space between the support and the respective corner sections of the sidewalls.

It is advantageous if the large container can be quickly filled and emptied and is also re-usable. To this end, a tubular connector, for example, a chute, may be provided in the cover and/or floor. The chute may be made of the same material as that of the cover or floor, respectively, and be joined thereto by means of a welded seam. Some form of cover may be provided on the opening of the chute to keep contaminants out. It is then a simple manner to close the large container by tying off the chute, or, if the chute is long enough, by tying it into a knot. The chute allows the container to be filled or emptied without releasing dust to the environment and also has the advantage that the large container does not have to be welded shut to seal it for transport and storage and then later be destroyed by cutting it open to gain access to the contents. The ability to easily close off the chute also means that bulk material may be filled or discharged in allotments or portions, rather than all at once.

The chute, whether a fill chute or a discharge chute, may also be made of a fabric that is lighter in weight than the fabric of the sidewalls, because the chute does not have to withstand the greater stresses and forces that are exerted on the sidewalls. The result is that the chute may be handled quite easily and easily tied off to to provide a leak-proof closure. When it is not the intent to empty the large container by turning it upside down, then the cover may also be made of the lighter weight material that is also used for the chute, because the cover does not have to withstand the forces that would be exerted on the cover were the container to be upended.

Alternatively, the cover or the floor may be constructed as a so-called apron, which provides an opening over almost the entire cross-section of the container. This embodiment particularly accelerates the filling and/or emptying operations, depending on whether the apron is provided on the cover or the floor.

Different types of large containers may be constructed according to the invention, including a dimensionally stable container with reinforced corner areas on the inside, a container having a separate inliner, or a container with a laminated liner, which may include one or more layers.

BRIEF DESCRIPTION OF THE DRAWINGS

The present invention is described with reference to the accompanying drawings, which are purely schematic. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
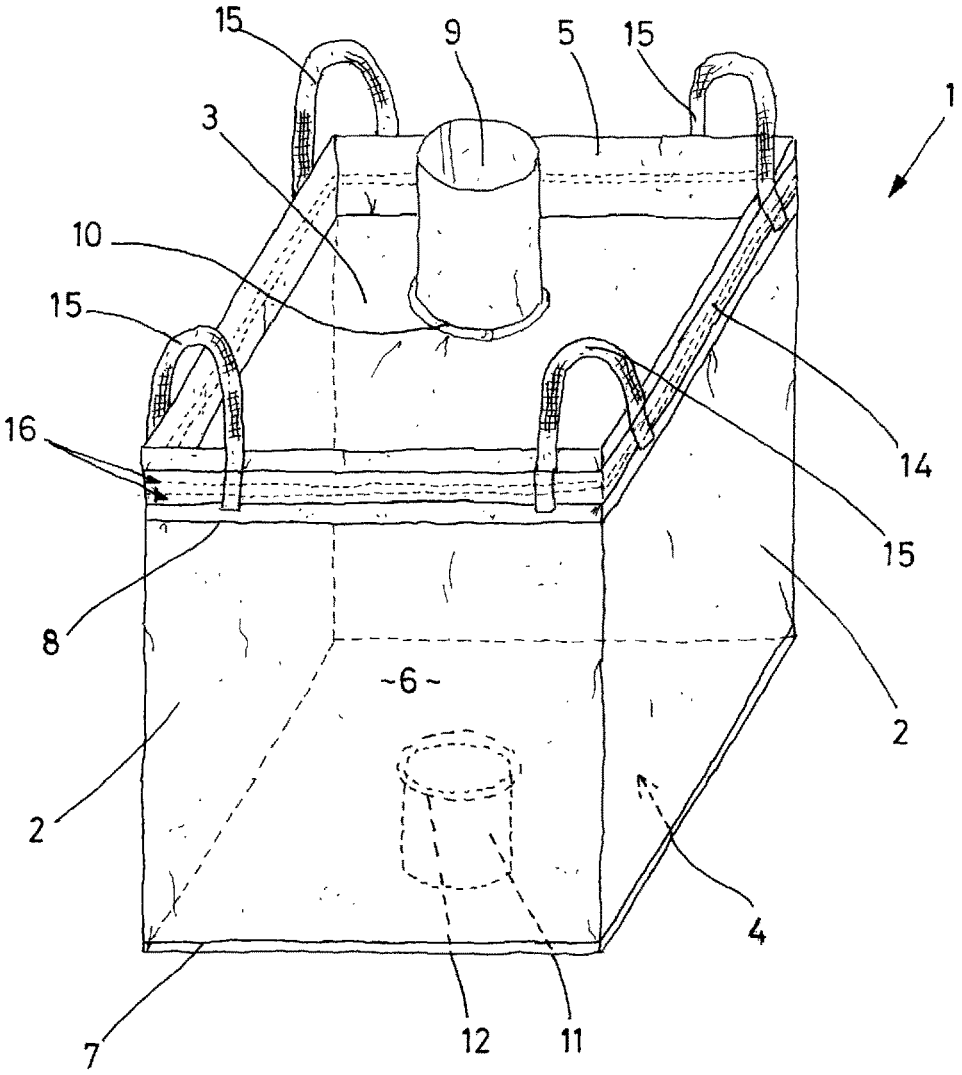
FIG. 1 is a perspective view of a flexible large container according to the invention.

FIG. 1 shows a flexible large container 1 according to the invention, the basic construction comprising sidewalls 2, a cover 3, and a floor 4, all made of a woven fabric. The fabric of the sidewalls 2 extends upward beyond the cover 3, forming a hem 5. Openings, not shown in the figure, may be provided in the hem 5 for drainage purposes. As shown, the large container 1 is rectangular in shape. These large containers 1 are filled with bulk material, such as grains, powdered material, pharmaceuticals, chemicals, etc.

The large container 1 has a usable space 6 that is bounded by the sidewalls 2, the cover 3, and the floor 4, all made of a woven fabric. The large container 1 is constructed such, that the usable space 6 is leak-proof and capable of reliably containing even very finely powdered bulk material. To create this leak-proof space 6, multiple fabric sheets are welded or fused together to form the sidewalls 2, the cover 3, and the floor 4. The term "welded seam" is used hereinafter to refer to this type of joining, because it is the commonly used term for a welded joining. In contrast to a stitched seam that inevitably has stitch holes, the welded seam 7 is a welded line, in which the fabric sheets of the large container 1 are joined to each other in a stitchless manner, i.e., are not perforated by stitch holes.

There are a number of ways to create the sidewalls 2. Four fabric sheets, or two U-shaped sheets may be welded together, or two parallel edges of a single sheet may be welded together, or a tubular woven fabric, such as can be produced on a circular loom, may be used to provide the four sidewalls 2. A U-shaped sheet also includes an L-shaped sheet with a second straight sheet. The floor 4 is joined to the sidewalls 2 by means of a lower welded seam 7 and the cover 3 by means of an upper welded seam 8 to complete the usable space 6. Thus, the usable space 6 is formed by sidewalls 2, floor 4, and cover 3 that are joined by means of welded seams only, so that the usable space 6 has no stitch holes, i.e., is stitchless and, therefore, leak-proof.

A fill tube or chute 9 is joined to the cover 3 by means of an upper welded seam 10. This fill tube 9 may be made of the same flexible fabric as that of the cover 3. Similarly, a discharge tube or chute 11 is joined to the floor 4 by a lower welded seam 12 and may be made of the same fabric as that of the floor 4.

A belt 14 is sewn onto the hem 5 that extends up above the cover 3. The belt surrounds the hem 5 on the outside. One or more lines of stitching 16 may be stitched through the belt 14 and the hem 5 to securely attach the belt 14 to the hem 5. Parallel stitch lines 16 are shown in FIG. 1, but it is understood that a zig-zag stitch may also be used. The perforations, i.e., stitch holes that are thereby made on the hem 5 and the belt 14 are uncritical regarding the desired leak-proofness of the large container 1, because these perforations are outside the usable space 6.

Lift loops 15 are attached to the hem 5 at the upper four corners of the large container 1. These lift loops 15 allow a conventional hoist means to lift and maneuver the large container 1. The lift loops 15 may be made of the same material as that of the belt 14 and the ends of the loops 15 sewn to the belt 14 and the hem 5.

Figure 2:
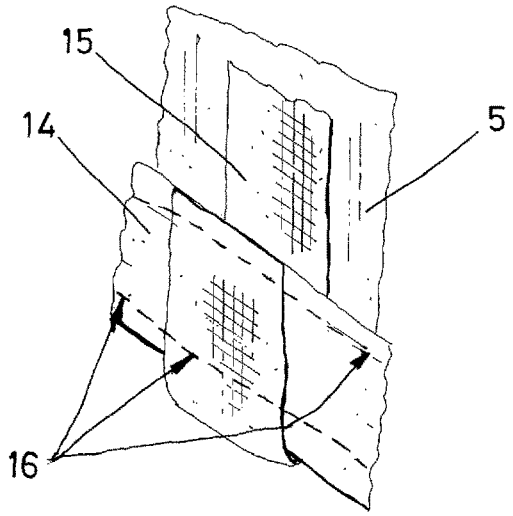
FIG. 2 illustrates in detail how a lift loop is attached to a belt.

FIG. 2 illustrates a method of attaching an end of the lift loops 15 to the belt 14, whereby only a small section is shown of the belt 14 and the lift loop 15. An end section of the lift loop 15 is U-shaped and wraps over the belt 14, so that the lift loop 15 makes contact with both sides of the belt 14. Two stitch lines 16 are shown, just as an example, that are stitched through all three layers of the lift loop 15 and the belt 14 to securely fasten the lift loop 15 to the belt 14. Joined in this way, the high tensile forces are passed on from the lift loop 15 to the belt 14, thereby distributing the heavy loading that is initially applied to the lift loops 15. Furthermore, when stitching the loop 15 to the belt 14, the stitching 16 may be stitched at the same time through the hem 5.

Instead of attaching the loops 15 and belt 14 together in a single step, the lift loops 15 may be attached to the belt 14 in a separate step, and then subsequently, the belt 14 with the lift loops 15 be stitched to the hem 5 by means of the stitch lines 16.

In the embodiment shown in FIG. 1, the belt 14 extends all around the hem 5. Alternatively, however, the lift loops 15 may be formed by the belt 14 itself, rather than as separate elements. In this case, the belt 14 is not stitched to the hem 5 at the corners above the cover 3, but rather, is left unattached to the hem, so that material of the belt is lifted up above the upper limit of the hem to form an omega shape (a), i.e., a loop 15.

Figure 3:
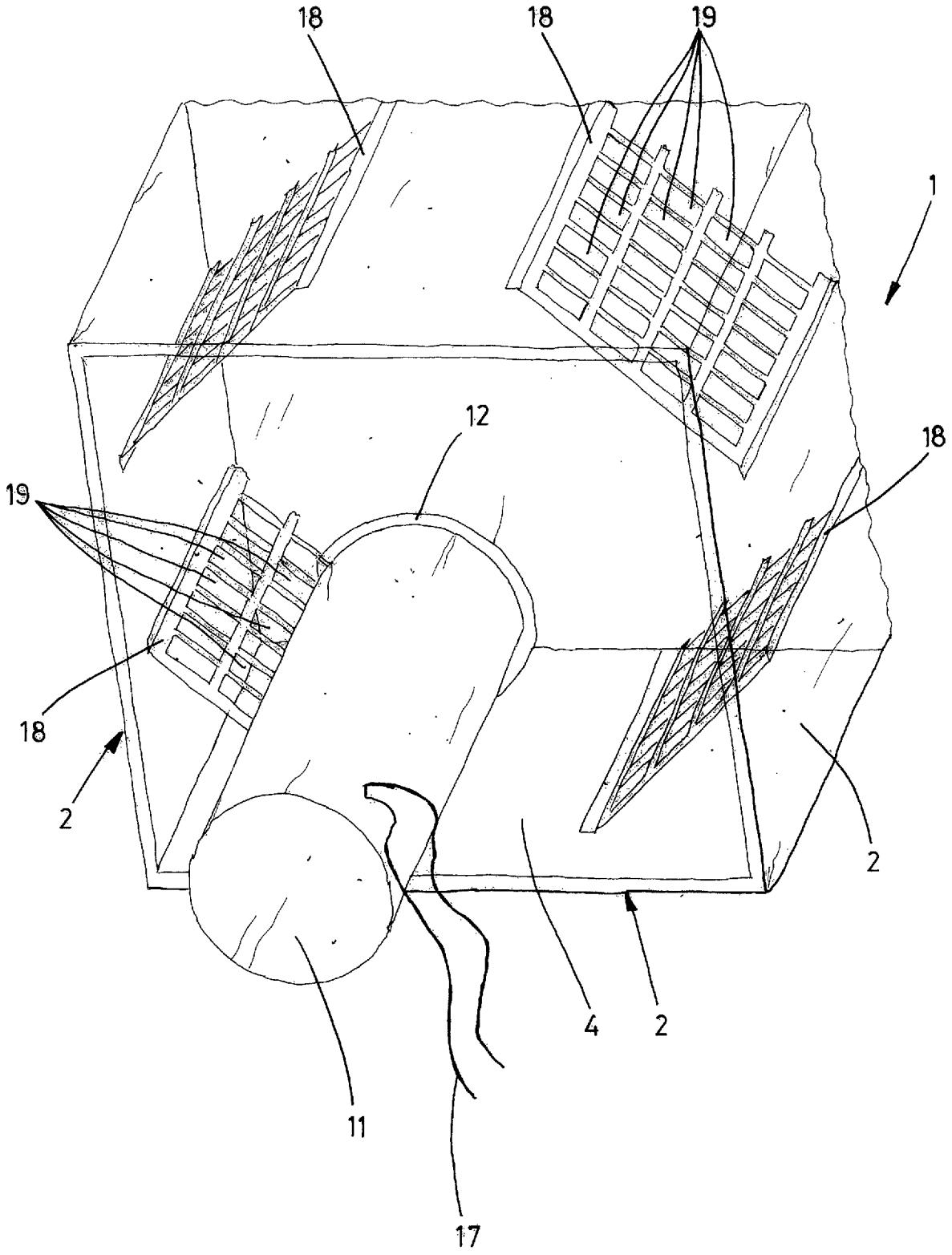
FIG. 3 is a perspective view onto a horizontally cut flexible large container that is constructed as a dimensionally stable container.

FIG. 3 is a bottom perspective view of the flexible large container 1 according to the invention, showing the discharge tube 11 welded to the floor 4 by means of the lower welded seam 12. A tie 17 is provided as a means of closing, i.e., tying off, the tube 11. The tie 17 is stitched to the tube 11, so as to leave two free ends that can then be wrapped around the tube 11 to close it.

Although not shown in the figures, it is understood that the tie 17 may also be added to the large container 1 as a separate element or one of its two ends may be loosely stitched tacked to the large container 1, to prevent it from getting lost. The tie 17 is then either detached from the large container 1, for example, cut off or torn off, or is long enough so that, even when still attached to the large container 1, the free end may still be used to tie off the discharge tube 11.

The large container 1 is shown as transparent in FIG. 3 and only up to a part of its overall height, so that the upper areas of the sidewalls 2, the cover 3, the hem 5, etc., are not visible. In the embodiment shown, the large container 1 is constructed as a dimensionally stable container, having a diagonally extending support 18 that is attached to each of two adjacent sidewalls 2 and that extends vertically in the corner area, so as to prevent the two sidewalls from folding in on to each other. The supports 18 have a plurality of openings 19, so that the bulk material can readily flow into or out of the triangular space bounded between the respective sidewalls and the support 18. In order to achieve a complete emptying of the large container 1, the supports 18 do not extend all the way to the floor 4 and to the cover 3, but rather, end some distance before.

Figure 4:
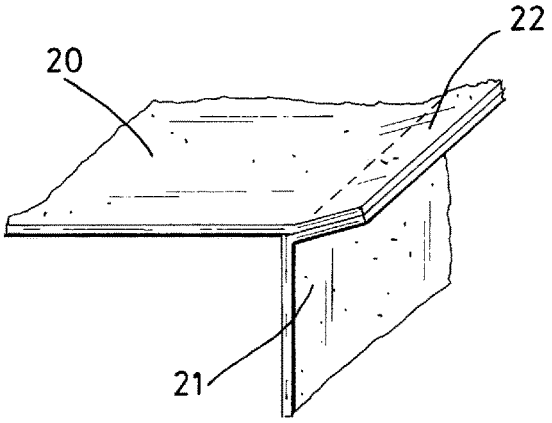
FIG. 4 illustrates a conventional seam for joining two fabric sheets.

FIG. 4 illustrates a conventional seam for stitching two fabric sheets 20 and 21 together. The two fabric sheets 20 and 21 abut each other at an angle and an overlap section in which the fabric sheets are parallel to each other then extends away from the abutted joint, forming a so-called flag 22 and overall an approximately Y-shaped seam area. Forces that are exerted on the large container 1 exert tensile forces on this type of stitched seam and act to pull the seam apart.

Figure 5:
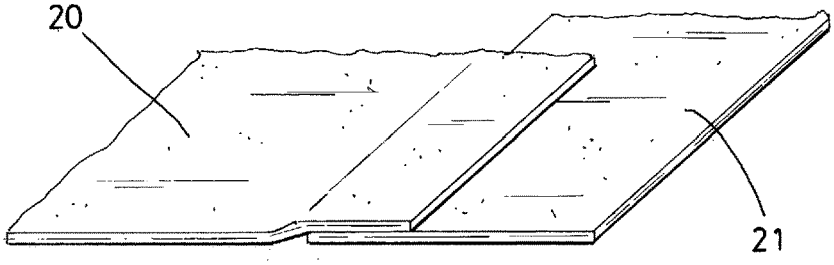
FIG. 5 illustrates an overlapping seam.

FIG. 5 illustrates a method of joining two fabric sheets 20 and 21 together for the large container 1 according to the invention. The edge areas of the two fabric sheets 20 and 21 are placed so as to overlap each other and this overlapped area is then fused or welded together to form a welded seam, i.e., a stitchless seam. The forces acting on this type of seam are shear force, rather than tensile forces, and because of the overlapping construction, this welded seam is capable of withstanding higher loading.

Figure 6:
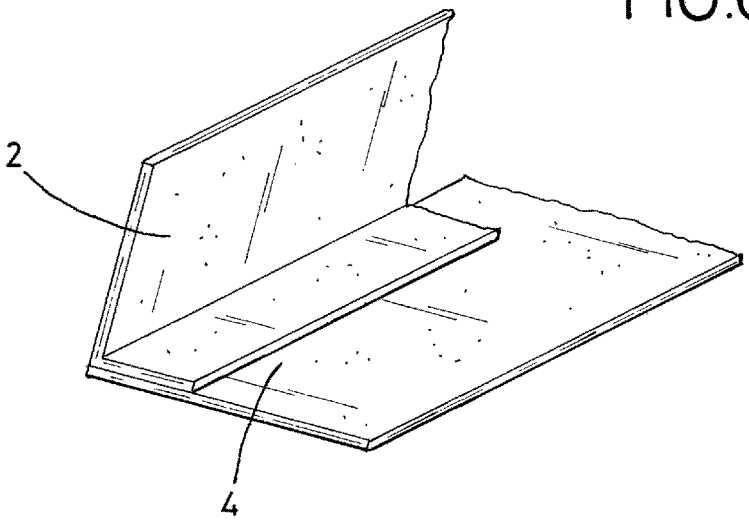
FIG. 6 illustrates a seam according to FIG. 5, in the transition area from the floor to a sidewall of the large container.
Figure 7:
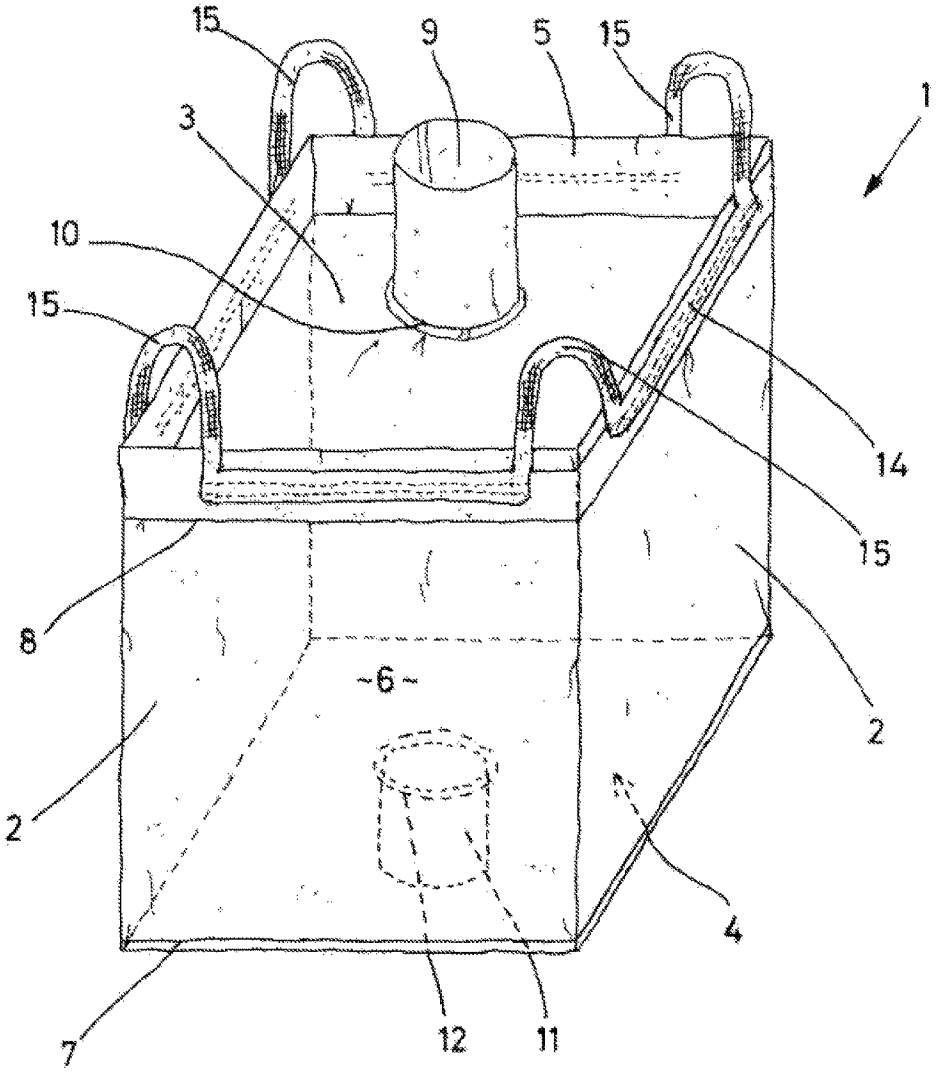
FIG. 7 illustrates a perspective view of the flexible large container with lift loops having an Omega-shape.

FIG. 6 illustrates the overlapping welded seam shown in FIG. 5, where the floor 4 transitions to the sidewall 2 of the large container 1. In the illustration, the edge section of the fabric sheet for the sidewall 2 is placed on top of the edge section of the fabric sheet for the floor 4 and, once the two sections are welded together, the sidewall 2 is folded upward. It is understood, that the edge section of the fabric sheet for the floor 4 could just as well be placed on top of the edge section of the sheet for the sidewall 2.

It is understood that the embodiments described herein are merely illustrative of the present invention. Variations in the construction of the large container may be contemplated by one skilled in the art without limiting the intended scope of the invention herein disclosed and as defined by the following claims.

The invention claimed is:

1. A flexible large container for receiving bulk material, the flexible large container comprising:

a plurality of fabric sheets that are woven with weave fibers and that are assembled together to form a leak-proof stitchless usable space having four sidewalls, a floor, and a cover;

a hem that is formed by the four sidewalls, an upper end of these four sidewalls extending upward beyond the cover, such that the hem is above the usable space;

a liner that is laminated to sides of the plurality of fabric sheets that face in toward the usable space;

a belt that extends circumferentially around the hem;

a plurality of lift loops, each lift loop of the plurality of lift loops having a lower end that is U-shaped with the U-shaped end having a first layer and a second layer, the belt sandwiched between the first layer and the second layer, the plurality of lifts loops and the belt stitched to the hem with the stitching extending through the first layer, the belt, and the second layer;

the hem having reinforced woven sections wherein the woven fabric where the lift loops attach has a higher density of the weave fibers than a usual density of the weave fibers of the plurality of fabric sheets;

wherein stitching the plurality of lifts loops to the reinforced woven sections causes a distribution of a lift load over an entire height of the flexible large container;

wherein the liner contains polyethylene;

wherein the plurality of fabric sheets contain polyethylene; and wherein the plurality of the fabric sheets that surround the usable space have seam edges and wherein the seam edges of each of two adjacent sheets of the plurality of fabric sheets are overlapped.

2. The flexible large container of claim 1, wherein the plurality of fabric sheets that form the usable space are woven with the weave fibers that are woven in two directions that cross each other and wherein at least the weave fibers of one direction contain polyethylene.

3. The flexible large container of claim 2, wherein the weave fibers are synthetic tapes.

4. The flexible large container of claim 2, wherein the weave fibers are synthetic filaments.

5. The flexible large container of claim 1, wherein the polyethylene is a high density polyethylene.

6. The flexible large container of claim 1, further comprising a corner support, wherein any two adjacent sides of the four sidewalls form a corner area and wherein the corner support is attached to each of the two adjacent sidewalls, so as to extend diagonally across the corner area along a vertical section of the corner area, and wherein the corner support has openings that allow the bulk material to flow into the corner area.

7. The flexible large container of claim 1, further comprising a fill tube that is provided in the cover, wherein the cover and the fill tube are constructed as separate elements, wherein the fill tube is constructed of the same fabric as the cover, and wherein the fill tube and the cover are attached to each other by means of a welded seam.

8. The flexible large container of claim 1, further comprising a discharge tube that is provided in the floor, wherein the floor and the discharge tube are constructed as separate elements, wherein the discharge tube is constructed of the same fabric as the floor, and wherein the discharge tube and the floor are attached to each other by means of a welded seam.

9. The flexible large container of claim 1, wherein the overlapped seam edges are welded together to form a welded seam.

10. The flexible large container of claim 9, wherein an intermediate layer containing polyethylene is placed between the seam edges of the two adjacent sheets and is incorporated into the welded seam.

11. The flexible large container of claim 1, wherein the higher density of the weave fibers is at least twice the usual density of weave fibers in the plurality of fabric sheets.

12. The flexible large container of claim 1, wherein the liner consists of polyethylene and the plurality of fabric sheets consist of polyethylene.

* * * * *